United States Patent [19]

Anantharaman

[11] 4,025,013

[45] May 24, 1977

[54] SPACE SAVER DISH DRAINER SUPPORT

[75] Inventor: Muthuvaramadam K. Anantharaman, Flushing, N.Y.

[73] Assignee: The Raymond Lee Organization, Inc., New York, N.Y. ; a part interest

[22] Filed: May 12, 1976

[21] Appl. No.: 685,710

[52] U.S. Cl. ..... 248/163; 211/181; 248/175

[51] Int. Cl.[2] ..... A47F 7/00; A47C 21/00

[58] Field of Search ..... 248/163, 146, 153, 148, 248/149, 175, 117.2; 211/41, 181; 220/19

[56] References Cited

UNITED STATES PATENTS

| | | | |
|---|---|---|---|
| 744,315 | 11/1903 | Ecker | 220/19 X |
| 1,028,320 | 6/1912 | Boice | 220/19 |
| 1,493,948 | 5/1924 | Apple | 220/19 |
| 1,726,071 | 8/1929 | Howlett | 220/19 |
| 2,750,139 | 6/1956 | Young | 248/148 |
| 2,799,426 | 7/1957 | Kaye | 211/41 X |

FOREIGN PATENTS OR APPLICATIONS

| | | | |
|---|---|---|---|
| 772,827 | 4/1957 | United Kingdom | 220/19 |

*Primary Examiner*—J. Franklin Foss
*Attorney, Agent, or Firm*—Howard I. Podell

[57] ABSTRACT

A support platform for a kitchen dish drainer unit which conserves kitchen counter space. The support platform is formed of a continuous length of shaped wire bent in the form of a rectangular-shaped rim, the corners of which are each bent to form a U-shaped leg. Each leg is bent at its base to form a U-shaped toe lying in a plane generally parallel to the plane of the rim. An extension leg is bolted to one tow to raise it a distance above a kitchen counter, with the remaining three toes rested on the top edges of the border flange of the counter.

2 Claims, 7 Drawing Figures

REAR WALL

SPACE SAVER DISH DRAINER SUPPORT

SUMMARY OF THE INVENTION

My invention is a support platform for a kitchen dish drainer unit which conserves kitchen counter space. The support platform is formed of a continuous length of shaped wire bent in the form of a rectangular-shaped rim, the corners of which are each bent to form a U-shaped leg. Each leg is bent at its base to form a U-shaped toe lying in a plane generally parallel to the plane of the rim. An extension leg is bolted to one toe to raise it a distance above a kitchen counter, with the remaining three toes rested on the top edges of the border flange of the counter.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figures 1, 2, 3A, 3B, 3C, 3D, 3E:
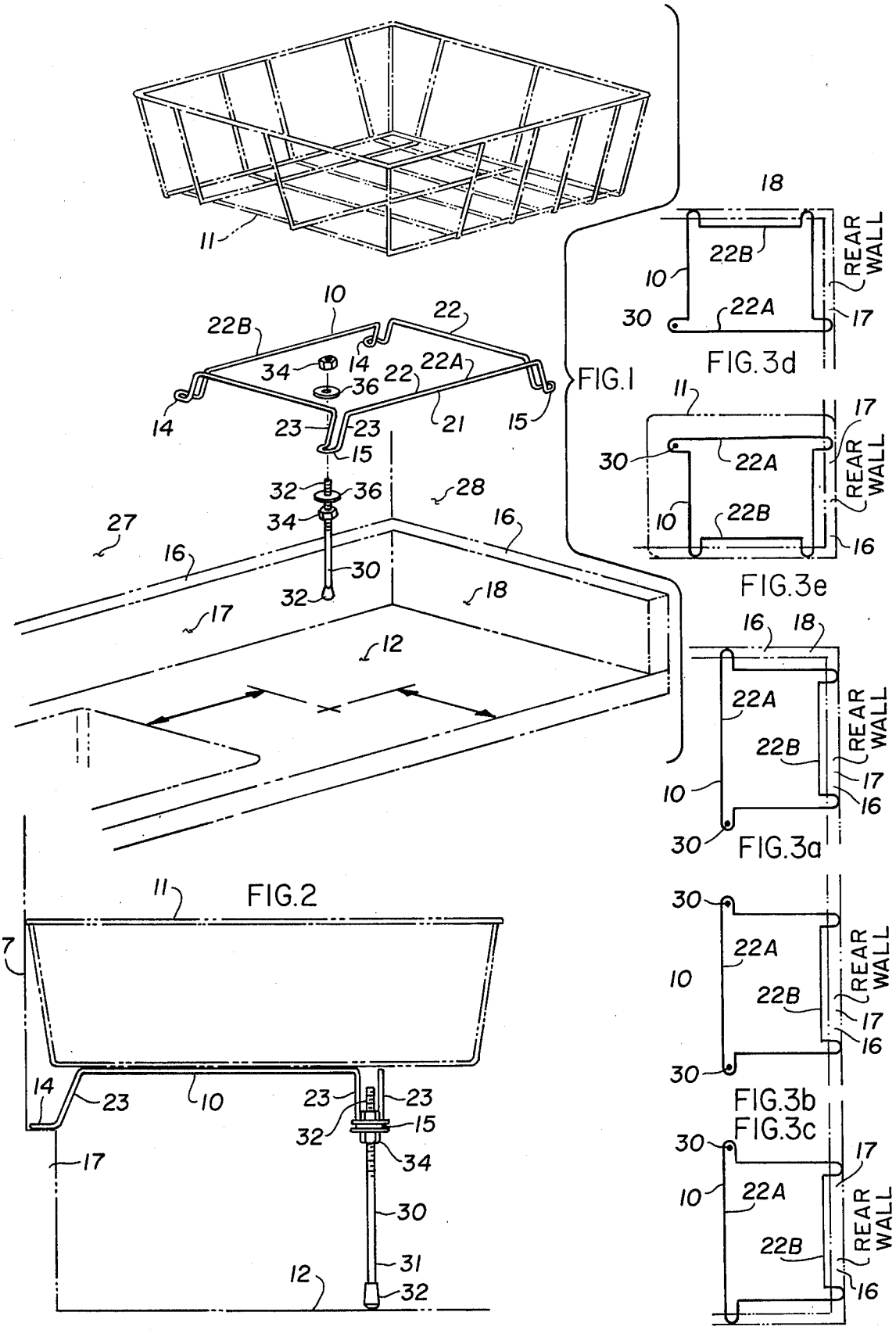
FIG. 1 is an exploded perspective view of the invention in use.
FIG. 2 is a side view of the invention in use.
FIG. 3*a* is a plan view of a first mounting arrangement of the invention.
FIG. 3*b* is a plan view of a second mounting arrangement of the invention.
FIG. 3*c* is a plan view of a third mounting arrangement of the invention.
FIG. 3*d* is a plan view of a fourth mounting arrangement of the invention.
FIG. 3*e* is a plan view of a fifth mounting arrangement of the invention.

Turning now descriptively to the drawings, in which similar reference characters denote similar elements throughout the several views, FIGS. 1–2 illustrate the space saver platform 10 upon which a conventional dish drainer unit 11 may be rested, with platform 10 elevated above the level of a kitchen counter 12 upon which an extension leg 30, attached to toe 15 of the platform 10, rests, with the remaining three leg toes 14, 14 and 15 resting on the upper horizontal edge 16 of the rear wall upright counter flange 17 and side wall counter flange 18 that bound a corner of the counter 12, and as shown in FIG. 3*d*.

Platform 10 is formed of a continuous length of shaped wire 21 bent to form a rectangular-shaped rim 22. The wire 21 is bent at each corner to form two parallel spaced leg members 23 bent at an acute angle to the plane of the rim 22 with both leg members 23 joined to a toe 14 or 15 in the form of a U-shaped section lying in a plane generally parallel to the plane of rim 22.

Preferably toes 15 adjoining a common rim element 22A are oriented to each extend away from each other parallel to the axis of rim element 22A, with toes 14 adjoining a common rim element 22B, which is parallel to rim element 22A, oriented to each extend away from rim element 22B along an axis perpendicular to rim element 22B so that toes 14 are adaptable for resting on a common rear wall flange 17 or side wall flange 18 with adjoining rim element 22B held a spaced distance from the rear wall 27 or side wall 28 adjacent said flange 17 or 18, as shown in FIGS. 2, 3*a*–3*d*.

A detachable extension leg 30 is readily fastened to a toe 14 or 15. Leg 30 is in the form of a shaft 31 fitted with a plastic or rubber support tip on a first end, with the opposed shaft end formed with a male thread 32 about which a pair of nuts 34 hold a pair of washers 36 engaged about the toe 14 or 15 of the platform.

Extension leg 30 is preferably fastened to a toe 15 to lift the attached toe 15 to the level of the edge 16 of the counter flanges 17 and 18 with the three remaining toes 14, 14 and 15 resting on two corner flanges 17 and 18 as shown in FIGS. 3*a*, 3*c*–3*e*. Alternately two legs 30 may be fastened to two toes 15 to mount the toes 14 of the platform 10 against a single wall flange 17 as shown in FIG. 3*b*.

Mounting of platform 10 on the wall counter flanges 17 or 18 lifts platform rim 22 and dish drainer 11, resting on rim 22, considerably above the level of the counter 12 to provide additional work area under the platform 10, besides maintaining a clean and dry surface below the dish drainer.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the U.S. is:

1. A support platform for a kitchen rack which provides working space under said platform, in use, comprising a wire frame formed as a rim of four border members in substantially rectangular configuration joined to four support legs, said legs shaped to rest on the top edge of an upraised flange that bounds the surface of a kitchen counter, and said rim generally extending in a common plane, together with an extension leg adaptable for detachable fastening to one of said frame legs so that the three remaining frame legs may rest directly on the top edge of corner flanges of a kitchen counter where each such flanges abuts a vertical wall, with the said extension leg resting on a lower level of the surface of the counter, when fastened to the said frame leg, in which each frame leg is formed to two parallel wire members joined at their base by a toe section formed as a U-shaped section of wire, said toe bent to rest in a plane parallel to the plane of the rim of the frame, with each said toe section aligned to extend in a direction away from the rim of the frame, and with each of the said parallel wire members joined to a separate leg of the U-shaped wire of the toe section at a first end of each frame leg and with each of the said parallel wire members joined to a separate border member of the rim such that an open recess continuously extends, from the open area bounded by the border members, to the open area bounded by the U-shaped wire of the toe section, with the extension leg formed as a shaft, threaded along one end section, together with a pair of female threaded means of a size to each matingly engage the said end-section and to grip the toe section when the said end section extends through the open area bounded by the toe section, such that the extension leg may be readily removed from an attached frame leg when said female threaded means are rotated away from each other, by sliding the said end section of the shaft, along said open recess into the open area bounded by the border members.

2. The combination as recited in claim 1 in which the wire frame is formed of one continuous length of shaped wire.

* * * * *